United States Patent [19]

Franchini et al.

[11] Patent Number: 4,461,252

[45] Date of Patent: Jul. 24, 1984

[54] CARBURETOR FITTED WITH A DEVICE FOR FEEDING THE ENGINE WITH LEAN MIXTURE DURING ACCELERATOR RELEASE

[75] Inventors: Mauro Franchini, Bologna; Arnaldo Veraldi, Casalecchio di Reno, both of Italy

[73] Assignee: Weber S.p.A., Italy

[21] Appl. No.: 474,058

[22] Filed: Mar. 10, 1983

[30] Foreign Application Priority Data

Mar. 17, 1982 [IT] Italy ..... 3372 A/82

[51] Int. Cl.[3] ..... F02M 3/04

[52] U.S. Cl. ..... 123/325; 261/DIG. 19

[58] Field of Search ..... 123/320, 325, 326, 332, 123/333; 261/DIG. 19

[56] References Cited

U.S. PATENT DOCUMENTS 3,455,260 7/1969 Mennesson ..... 261/DIG. 19
4,075,988 2/1978 Kato ..... 123/325 X
4,146,594 3/1979 Raud ..... 261/DIG. 19
4,253,437 3/1981 Haramoto ..... 123/325
4,387,681 6/1983 Ikeura et al. ..... 123/325

*Primary Examiner*—William A. Cuchlinski, Jr.
*Attorney, Agent, or Firm*—Stevens, Davis, Miller & Mosher

[57] ABSTRACT

A carburetor comprises: a main barrel; a throttle situated in the barrel; an idle system which, from a cavity full of fuel, opens into the main barrel through progression and idle mixture holes; the idle system comprises elements for metering fuel and air, which form a primary emulsion. There are several suitably sized passages in the idle system through which the fuel or emulsion flow; the following cooperate with the said passages: first elements for excluding the flow from some of the said passages, keeping at least one open to prevent the idle system from emptying during accelerator release; second organs for positioning the said first elements; third devices for recognizing accelerator release and checking the said second organs.

2 Claims, 3 Drawing Figures

CARBURETOR FITTED WITH A DEVICE FOR FEEDING THE ENGINE WITH LEAN MIXTURE DURING ACCELERATOR RELEASE

The invention is relative to carburetors for internal combustion engines and comprises a main barrel, a throttle which regulates the flow of mixture delivered by the carburetor and an idle system which prepares the mixture for the low consumption phases of the engine.

It was proposed to interrupt the flow of carburized mixture during accelerator release, in order to: reduce consumption, limit the amount of pollutants, increase the braking effect of the engine. In the known technique, the interception of the flow is achieved by means of two types of device; the first type of device positions the throttle with a very small opening so that all the delivery holes of the idling system are upstream; the second type is inserted in the idle system or idle jet, to close them. The control means for both types of devices may be electronic, electromagnetic or pneumatic.

The idle system equipped with a device of the known type tends to empty itself during accelerator release, so that when the accelerator is depressed again, the engine is fed by an incorrect mixture since a correct flow of fuel has not been re-established in the said system; this happens after the said system has filled with fuel and after a period of time which can be noticed during driving.

The main aim of this invention is to resolve the above-mentioned problems by creating a carburetor with an idle system which does not empty completely during accelerator release.

Another aim of this invention is to create a carburetor of the above-mentioned type, which delivers a flow of lean mixture during accelerator release, the strength of which does not depend on the position of the throttle with respect to the progression holes.

Figure 1:
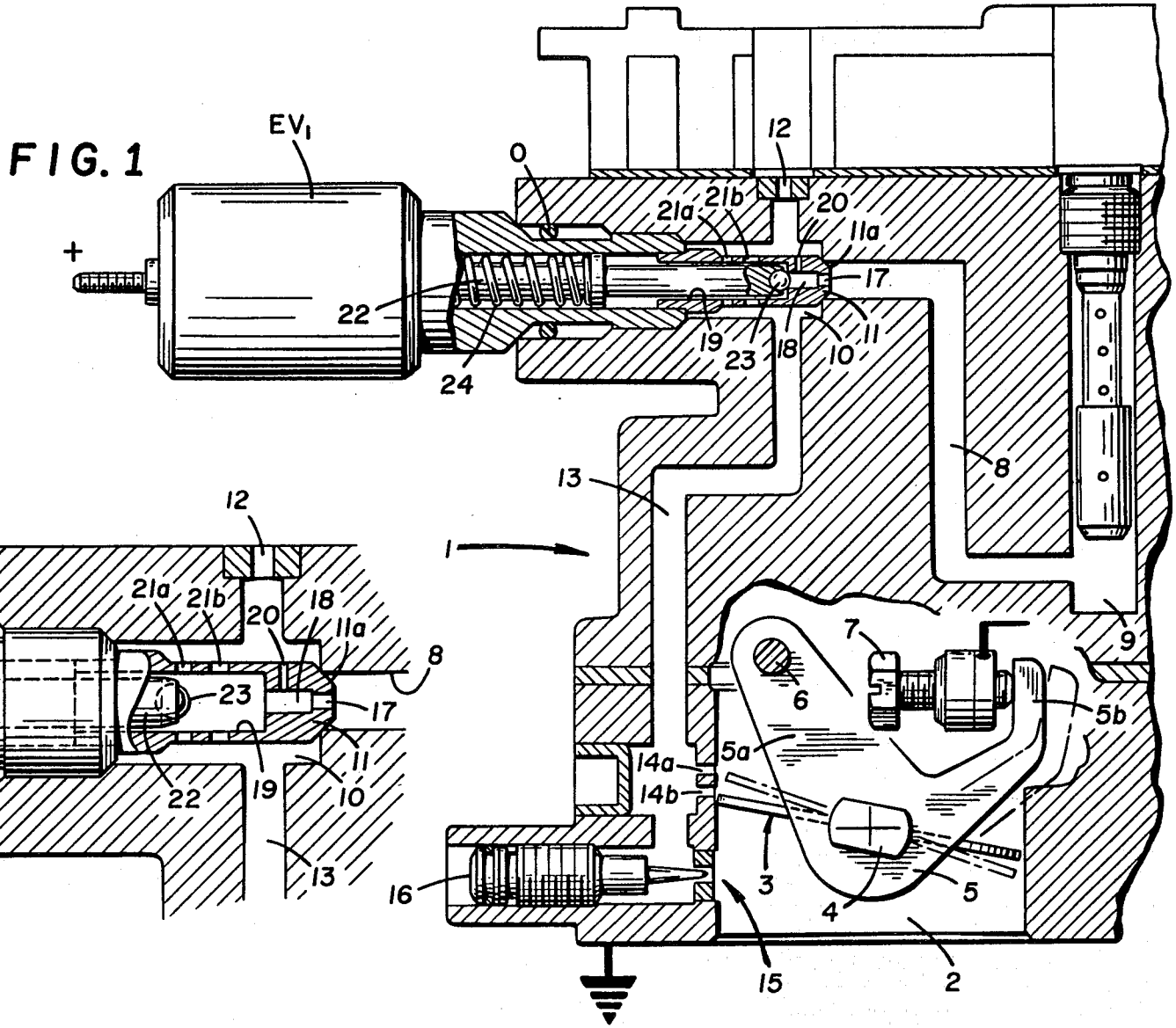
Figure 1A:
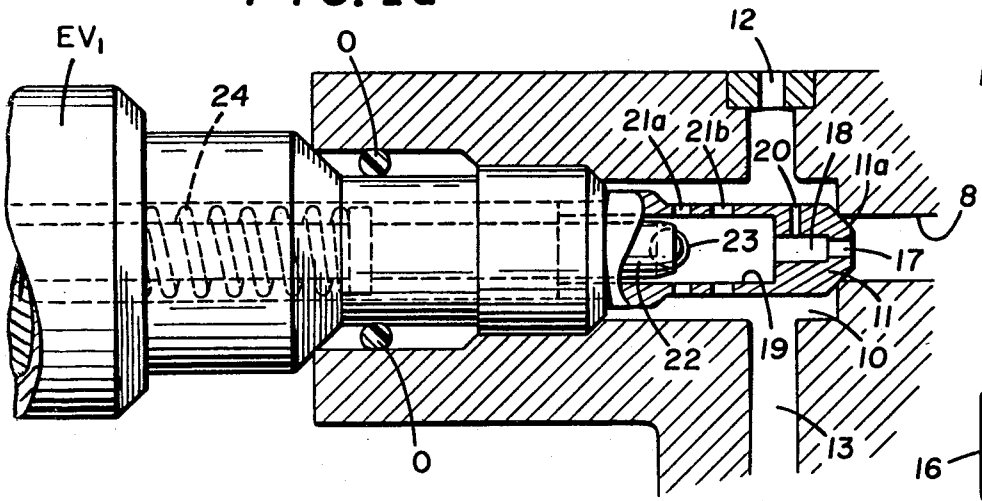

The invention therefore comprises a carburetor characterised as stated in the claims; other aims, characteristics and advantages of the invention can be better understood by referring to the enclosed figures, which illustrate two non-restrictive construction examples, in which:

FIG. 1 represents a partial cross-section of a carburetor according to the first construction version of the invention;

FIG. 1*a* represents the solenoid valve in an open position.

Figure 2:
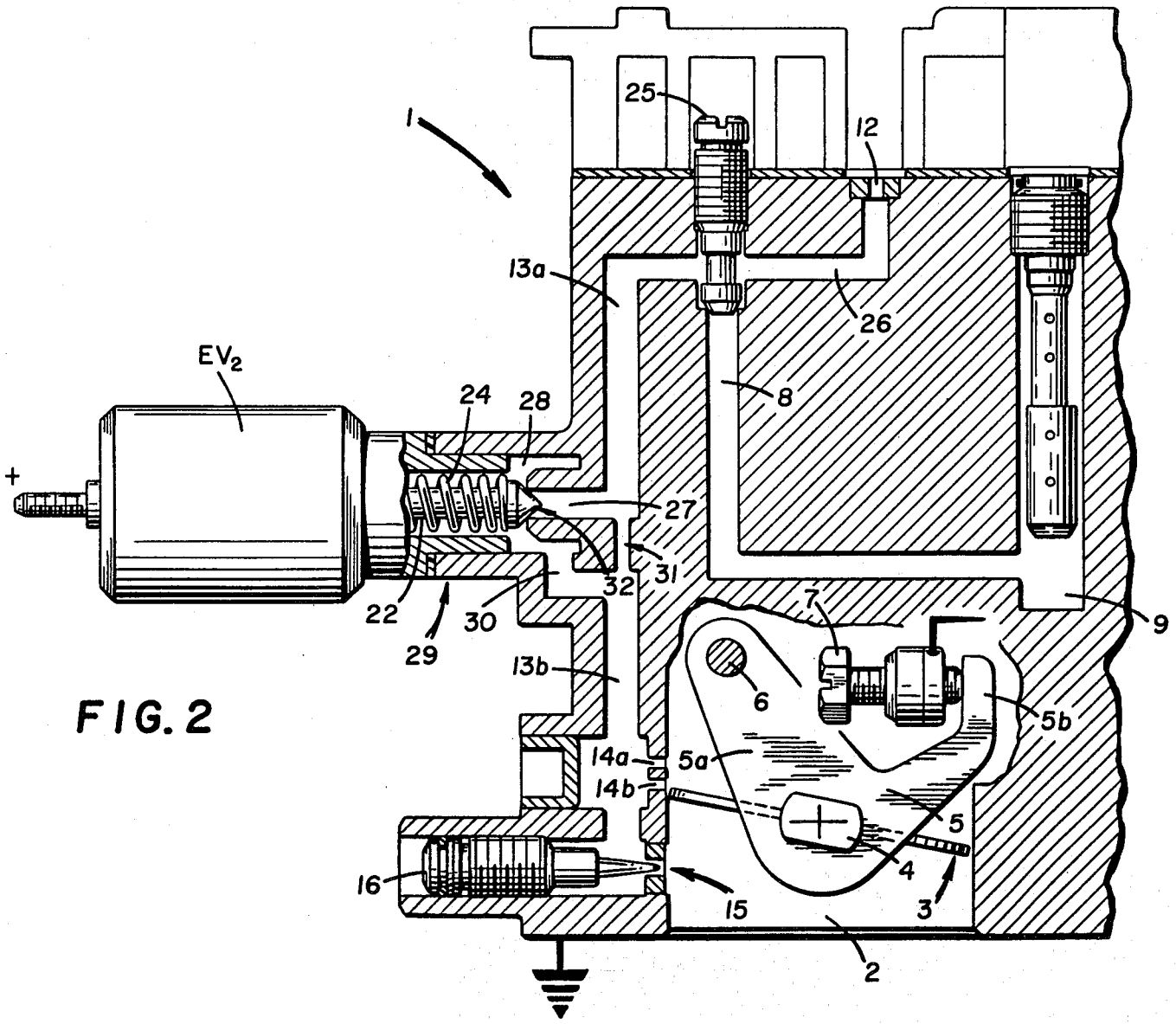

FIG. 2 represents a second partial cross-section of a carburetor according to the second construction version of the invention.

Referring to FIG. 1, a carburetor 1 comprises a main barrel 2, in which there is a throttle 3, rotating with a shaft 4 on which a control lever 5 is splined; by means of an arm 5*a*, the lever 5 supports the accelerator coupling 6 and, by means of an arm 5*b*, abuts against a speed adjusting screw 7, in order to define the position of the throttle 3 when the accelerator is released. The carburetor 1 comprises an idle system formed by a channel 8 which begins at the base of the well 9 and terminates in a cavity 10, in which an idling jet 11 is housed; the cavity 10 is connected to the atmosphere by means of a bush 12 which meters the emulsion air; a channel 13 connects the cavity 10 to the barrel 2, into which the said channel 13 opens by means of the progression holes 14*a* and 14*b* and an idle mixture hole 15, controlled by the taper point of a screw 16. The jet 11 comprises a hollow tubular element which consists of the following parts: a truncated cone section 11*a* which rests in the outlet of the channel 8; a calibrated hole 17 which meters the fuel passing from the channel 8 to a cavity 18 inside the jet 11; the said cavity 18 communicating, by means of an outlet, with a cavity 19 situated in the inner left-hand part of the jet 11. A radial hole 20 connects the two cavities 18 and 10; two radial holes 21*a* and 21*b* connect the two cavities 19 and 10. The cross-section of the hole 20 is notably smaller than the cross-section of the hole 17; the cross-sections of the two holes 21*a* and 21*b* are bigger than the cross-section of the hole 17. A rod-type obturator 22 is inserted in the cavity 19 and is integral with the keeper of a solenoid valve $EV_1$ which is supported by means of screw parts on the body of the carburetor 1, sealing agents 0 being present to prevent fuel from escaping. A spring 24 cooperates with the magnetic forces of the solenoid valve $EV_1$ to determine the correct position of the rod 22 terminating in a ball 23 which closes the passage between the cavities 18 and 19 under the action of the forces practiced by the solenoid valve $EV_1$ and by the spring 24. The screw 7 is connected electrically to a power unit, not shown, to inform it of the position of the lever 5 and consequently of the throttle 3.

The carburetor shown in FIG. 2 differs from the one described above in the following way: the idle jet does contain any maneuvering parts and is situated at the crossing of the channels 8 and 26 which, respectively, carry fuel from the well 9 and air from the bush 12; downstream from the jet 25 is a channel, the first part 13*a* of which, through an inlet 27, opens into a cavity 28 of a hollow cylindrical element 29 to carry the air-fuel emulsion; from an outlet 30 situated in the same cavity 28, the second part 13*b* of the said channel begins and opens into the barrel 2 by means of the holes 14*a*, 14*b* and 15. A channel 31 forms a direct link between the two channels 13*a* and 13*b*, with a notably smaller cross-section than that of the said channels 13*a* and 13*b*.

The obturator rod 22 terminates with a truncated cone element 32 to close the outlet under the action of the forces provided by the solenoid valve $EV_2$ and by the spring 24.

The functioning of the invention can be explained as follows, referring first to FIG. 1 and then to FIG. 2. During normal functioning of the engine, the throttle 3 is partially open, the arm 5*b* is not in contact with the screw 7 so that the control unit receives a signal corresponding to the non-closure of the throttle 3; on the other hand, if the rotation speed of the engine exceeds a first threshold $RPM_1$, the power unit is pre-set to control the solenoid valve $EV_1$; if instead the speed is lower than the threshold $RPM_1$, the power unit is not pre-set for the same intervention. Let us suppose that the speed is greater than $RPM_1$ and that the arm 5*b* is not in contact with the screw 7; the power unit sends a signal to the solenoid valve $EV_1$ which positions the obturator 22 towards the left, so that the ball 23 does not close the passage between the cavities 18 and 19; the fuel coming from the well 9 through the channel 8, is metered by the hole 17 and passes into the cavity 18; from here, partly through the hole 20 to reach the cavity 10 and to a much greater extent through the passage between the two cavities 18 and 19 and from the latter through the holes 21*a* and 21*b*, it enters the cavity 10; here, the fuel combines with the air coming from the bush 12 to form an emulsion which, through the channel 13, the holes 14*a*, 14*b* and 15, reaches the barrel 2 to form the correct strength of feed mixture. If under these conditions the accelerator is released, the arm 5*a* abuts against the screw 7; an electric signal follows informing the power unit that the throttle is closed; the power unit enables the solenoid valve $EV_1$ to move the obturator 22 towards the right, so that the ball 23 closes the passage between the two cavities 18 and 19; under these conditions, the flow of fuel is determined by the dimensions of the hole 20 and is much less than the flow which is established when the said passage is open, but is nevertheless sufficient to prevent the channel 13 from being emptied of fuel. When the engine speed falls below a second threshold $RPM_2$ $RPM_1$, the power unit sends a signal which enables the solenoid valve $EV_1$ to move the obturator 22 towards the left, opening the said passage and restoring the correct flow of fuel through the idle system. If, however, the driver operates the accelerator before the engine speed falls below the threshold $RPM_2$, then the movement of the arm 5*b* away from the screw 7 informs the power unit that the accelerator is no longer released. The power unit sends a signal to the solenoid valve $EV_1$ which enables it to move the obturator 22 towards the left in order to open the said passage; since the channel 13 is not completely empty, the strength of the mixture delivered by the carburetor 1 returns immediately to the optimum value, maintaining the vehicle in correct driving condition.

The functioning of the carburetor shown in FIG. 2 does not differ from the functioning described above, except for the fact that the obturator 22 opens and closes the inlet 27 to the cavity 28 with the truncated cone element 32 and that during the closure of the inlet 27, part of the emulsion passes directly from the channel 13*a* to the channel 13*b* through the short channel 31, thereby ensuring that the idle system is not left empty during accelerator release. Since the passages which determine the flow of fuel or emulsion during accelerator release are upstream of the holes 14*a*, 14*b* and 15, the strength of the mixture delivered during accelerator release does not depend on the position of the throttle 3 with respect to the said holes, but on the dimensions of the hole 20 or of the short channel 31.

We claim:

1. Carburetor fitted with a device for feeding the engine with lean mixture during accelerator release, comprising at least: a main barrel; a throttle situated in the main barrel and rotating with a shaft, on which a control lever is splined; an idle system which connects a cavity full of fuel to the main barrel by means of progression and idle mixture holes; the carburetor is characterised by the fact that the idle system comprises at least: a cavity for the fuel or emulsion flow; passages situated at the inlet and the outlet of the cavity; primary holes for direct connection of the parts of the system upstream of the said passages with the parts for the system downstream; the said holes being upstream of the said progression holes in the system; secondary holes situated downstream of the passages; the said primary holes being intended to establish a flow of fuel which is notably less than the flow established by the metering elements; the said secondary holes not affecting the flow of fuel; an obturator device being present to close at least one of the said passages; electromechanical control means being provided to operate the obturator device during accelerator release and being subject to the action of a control unit for receiving electric signals from a contact which closes when the accelerator is released.

2. Carburetor, as in claim 1, in which a speed screw defines the position of the throttle during accelerator release, characterised by the fact that the obturator is part of a solenoid valve for receiving control signals from the said electronic control unit; there being an electrical connection between the screw and the control unit to inform the control unit of the position of the throttle; two thresholds of angular speed of the engine, $RPM_1$ and $RPM_2$, being memorised in the control unit; above the first threshold $RPM_1$, the control unit enabling the solenoid valve to position the obturator to close one of the said passages, with the throttle closed; below the threshold $RPM_2$, the control unit enabling the solenoid valve to position the obturator to open the said passage.

* * * * *